US009744404B2

(12) United States Patent
Shiao et al.

(10) Patent No.: US 9,744,404 B2
(45) Date of Patent: Aug. 29, 2017

(54) LAT PULLDOWN FITNESS DEVICE

(71) Applicant: NATIONAL TAIPEI UNIVERSITY OF TECHNOLOGY, Taipei (TW)

(72) Inventors: Yaojung Shiao, Taipei (TW); Ting-Yen Lin, Taichung (TW)

(73) Assignee: NATIONAL TAIPEI UNIVERSITY OF TECHNOLOGY (TW)

( * ) Notice: Subject to any disclaimer, the term of this patent is extended or adjusted under 35 U.S.C. 154(b) by 462 days.

(21) Appl. No.: 14/561,260

(22) Filed: Dec. 5, 2014

(65) Prior Publication Data

US 2016/0067548 A1 Mar. 10, 2016

(30) Foreign Application Priority Data

Sep. 5, 2014 (TW) ..... 103130705 A

(51) Int. Cl.
*A63B 24/00* (2006.01)
*A63B 21/005* (2006.01)
(Continued)

(52) U.S. Cl.
CPC ..... *A63B 24/0087* (2013.01); *A63B 21/0058* (2013.01); *A63B 21/00845* (2015.10); *A63B 21/4035* (2015.10); *A63B 21/4043* (2015.10); *A63B 23/03583* (2013.01); *A63B 21/154* (2013.01); *A63B 23/0233* (2013.01); *A63B 23/1218* (2013.01); *A63B 71/0622* (2013.01);
(Continued)

(58) Field of Classification Search
CPC . A63B 24/00; A63B 24/0062; A63B 24/0087; A63B 21/0058; A63B 21/154; A63B 21/4035; A63B 21/00845; A63B 21/4043; A63B 2024/0068; A63B 2024/0093; A63B 2225/09; A63B 2225/093; A63B 2225/12; A63B 2071/009; A63B 2071/0638
See application file for complete search history.

(56) References Cited

U.S. PATENT DOCUMENTS 5,597,375 A * 1/1997 Simonson ..... A63B 23/1254 482/100
8,267,842 B2 * 9/2012 Schocke ..... A61B 5/221 482/111
(Continued)

*Primary Examiner* — Glenn Richman
(74) *Attorney, Agent, or Firm* — Schmeiser, Olsen & Watts, LLP

(57) ABSTRACT

A lat pulldown fitness device includes a base, a magneto-rheological fluid (MRF) resistance provider, a motor, a gear train, pulleys, a cable assembly, a pulldown bar and a controller. The MRF resistance provider and the motor provide a resistance functioning as a load weight of pulling down the pulldown bar. The controller controls a current input to the MRF resistance provider to change the strength of the resistance generated from the MRF resistance provider. During a workout, the resistance provided by the lat pulldown fitness device is changeable precisely, conveniently, and quickly. Unlike its conventional counterparts which require bumper plates for use as weights, the lat pulldown fitness device is not limited to weight adjustment based on unit bumper plate but features plenty choices and controllable resolution in terms of strength of training. The MRF resistance provider is more compact and lightweight than its conventional counterparts.

10 Claims, 6 Drawing Sheets

(51) Int. Cl.

| | |
|---|---|
| ***A63B 21/008*** | (2006.01) |
| ***A63B 23/035*** | (2006.01) |
| *A63B 23/02* | (2006.01) |
| *A63B 71/06* | (2006.01) |
| *A63B 21/00* | (2006.01) |
| *A63B 23/12* | (2006.01) |
| *A63B 71/00* | (2006.01) |
| *A63B 69/00* | (2006.01) |

(52) U.S. Cl.

CPC ..... *A63B 2024/0068* (2013.01); *A63B 2024/0093* (2013.01); *A63B 2069/0062* (2013.01); *A63B 2071/009* (2013.01); *A63B 2071/0638* (2013.01); *A63B 2208/0233* (2013.01); *A63B 2210/00* (2013.01); *A63B 2225/09* (2013.01); *A63B 2225/093* (2013.01); *A63B 2225/12* (2013.01)

(56) References Cited

U.S. PATENT DOCUMENTS

| | | | | |
|---|---|---|---|---|
| 9,409,053 | B1 * | 8/2016 | Todd | A63B 24/00 |
| 2012/0109025 | A1 * | 5/2012 | Weinberg | A63B 23/14 601/5 |
| 2017/0050069 | A1 * | 2/2017 | Ky | A63B 21/0083 |

* cited by examiner

LAT PULLDOWN FITNESS DEVICE

CROSS-REFERENCE TO RELATED APPLICATION

This non-provisional application claims priority under 35 U.S.C. §119(a) on Patent Application No(s).103130705 filed in Taiwan, R.O.C. on Sep. 5, 2014, the entire contents of which are hereby incorporated by reference.

FIELD OF TECHNOLOGY

The present invention relates to lat pulldown fitness devices, and more particularly, to a lat pulldown fitness device capable of adjusting a load weight.

BACKGROUND

A conventional lat pulldown fitness device comprises supports, a bar, a cable, a plurality of pulleys, a plurality of bumper plates, and a seat. The pulleys are disposed on the supports. The cable straddles the pulleys and has two ends connected to the bumper plates and the bar, respectively. A user applies a force stronger than the weight of bumper plates to pull the bar downward repeatedly in order to exercise muscles. To adjust the applied force required for pulling the bar downward in order to exercise muscles, the user adjusts the pins of bumper plates in the lat pulldown fitness device in order to choose the weight required for a desirable strength level.

During a workout, the user has to stop exercising muscles for a while in order to remove the pins by hand and adjust a load weight. Furthermore, it is possible that the user inserting the pins in place stays so close to the bumper plates that the user might get hurt whenever a bystander pulls the bar inadvertently. Moreover, the conventional lat pulldown fitness device uses one bumper plate as a weight adjusting unit which has its limits on strength adjustment and selection. The commonest scenario of difficulty in strength adjustment and selection is that: the user is dissatisfied with the preceding weight chosen for the intended strength level but is exhausted when exercising muscles with the present weight chosen for the intended strength level, and in consequence the user fails to comply with the workout plan and meet the workout need.

Furthermore, in the absence of a fitness coach, the user is likely to exert forces so improperly that the bumper plates collide with each other or fall, thereby generating noise—terrifying neighbor users and damaging fitness equipment. In the absence of a fitness coach, the user is also likely to have his or her arms and shoulders injured while his or her hands are gripping the bar, because the total weight of the bumper plates outweighs the force generated from the user's hands, and thus the bumper plates fall to strain the user's arms and shoulders.

SUMMARY

It is an objective of the present invention to provide a lat pulldown fitness device characterized in that: a magnetorheological fluid (MRF) resistance provider and a motor operate together to produce a load weight; and the MRF resistance provider adjusts the magnitude of an input current and thereby changes a generated resistance, thereby allowing the load weight to be adjusted according to a user's needs conveniently and quickly.

In order to achieve the above and other objectives, the present invention provides a lat pulldown fitness device which comprises a base, a magnetorheological fluid (MRF) resistance provider, a controller, a gear train, a plurality of pulleys, a cable assembly, and a pulldown bar. Disposed on the base are a seat portion, a footrest portion, and a support frame. The footrest portion is disposed between the seat portion and the support frame. The MRF resistance provider is disposed on the base. The MRF damper comprises a magnetic field generating portion, a magnetically permeable external roller, and a shaft. The shaft is coupled to the magnetic field generating portion and received in the magnetically permeable external roller. The two ends of the shaft stick out of the magnetically permeable external roller. One of the two ends of the shaft connects to a spindle of a motor. The magnetically permeable external roller rotates relative to the shaft and the magnetic field generating portion. A magnetorheological fluid (MRF) is filled between the magnetically permeable external roller and the magnetic field generating portion. The magnetic field generating portion generates a magnetic field, such that the MRF generates an anti-shear stress between the magnetically permeable external roller and the magnetic field generating portion rotating relative thereto under the magnetic field. The gear train is disposed on the base. The gear train comprises a chain, a large gear, and a small gear. The small gear is coupled to the magnetically permeable external roller. The chain connects the large gear and the small gear. The pulleys are disposed on the support frame. The cable assembly is disposed on the base. The cable assembly comprises a reel and a cable. The reel is coupled to the large gear. A portion of the cable winds around the reel, and another portion of the cable straddles the pulleys. The pulldown bar is disposed at an end of the cable and hangs above the seat portion. The controller is electrically connected to the MRF resistance provider and the motor. The controller controls the strength of the magnetic field generated from the magnetic field generating portion, controls the driving of the motor, and controls the weight provided by the MRF resistance provider and the motor to pull the cable downward.

The lat pulldown fitness device further comprises a display screen. The display screen is electrically connected to the controller.

The lat pulldown fitness device further comprises a reflection mirror is disposed upright on the base and positioned between the footrest portion between the gear train.

As regards the lat pulldown fitness device, the display screen is a touchscreen mounted on the reflection mirror.

The lat pulldown fitness device further comprises a chip reader which is disposed on the support frame and electrically connected to the controller.

As regards the lat pulldown fitness device, the magnetic field generating portion comprises a magnetically permeable body, even-numbered magnetic poles, even-numbered magnetically permeable coils, even-numbered spacers, and two first covers. The magnetic poles are spaced apart and disposed circumferentially on the magnetically permeable body. Each magnetically permeable coil is disposed around a corresponding one of the magnetic poles. The spacers each adjoin two magnetic poles to hermetically seal the space between the two magnetic poles. The first covers flank the magnetically permeable body, the magnetic poles, and the spacers so as for the magnetically permeable coils to be hermetically sealed within a space defined jointly by the first covers, the magnetic poles, and the spacers. The shaft is coupled to the magnetically permeable body and sticks out of the first covers and the magnetically permeable external roller.

As regards the lat pulldown fitness device, currents in the magnetically permeable coils of two adjacent magnetic poles run in opposite directions.

As regards the lat pulldown fitness device, the magnetic poles each comprise a cylindrical magnetically permeable block and a curved magnetically permeable head. Each magnetically permeable coil is disposed around the cylindrical magnetically permeable block. The spacers are each curved, plate-like and disposed between two adjacent curved magnetically permeable heads, such that the magnetic field generating portion takes on a cylindrical shape upon completion of assembly.

As regards the lat pulldown fitness device, the magnetic field generating portion comprises two first washers. The first washers are each disposed between the first covers, curved magnetically permeable heads of the magnetic poles, and the spacers, respectively.

As regards the lat pulldown fitness device, the magnetically permeable external roller comprises an external cylinder, two second covers, and two second washers. The second covers flank the external cylinder. The second washers are each disposed between the second covers and the external cylinder.

In conclusion, the lat pulldown fitness device of the present invention is characterized advantageously in that: the MRF resistance provider and the motor operate in conjunction with each other to provide a downward-pulling weight; and a current supplied to the MRF resistance provider is placed under the control of the controller to control the MRF by adjusting the strength of the magnetic field of the magnetic field generating portion, thereby adjusting the output resistance of the magnetically permeable external roller. Hence, the lat pulldown fitness device according to the embodiment of the present invention changes a resistance precisely, conveniently, and quickly during a workout. Unlike the prior art which requires bumper plates, the lat pulldown fitness device according to the embodiment of the present invention is not restricted to a unit bumper plate as far as weight adjustment is concerned and thus offers more choices and control resolutions in strength adjustment. Furthermore, the MRF resistance provider of the lat pulldown fitness device according to the embodiment of the present invention is compact and lightweight as compared to the prior art which discloses stacking up bumper plates, not to mention that the lat pulldown fitness device of the present invention is thus compact and lightweight.

BRIEF DESCRIPTION

Objectives, features, and advantages of the present invention are hereunder illustrated with specific embodiments in conjunction with the accompanying drawings, in which.

DETAILED DESCRIPTION

Figure 1:
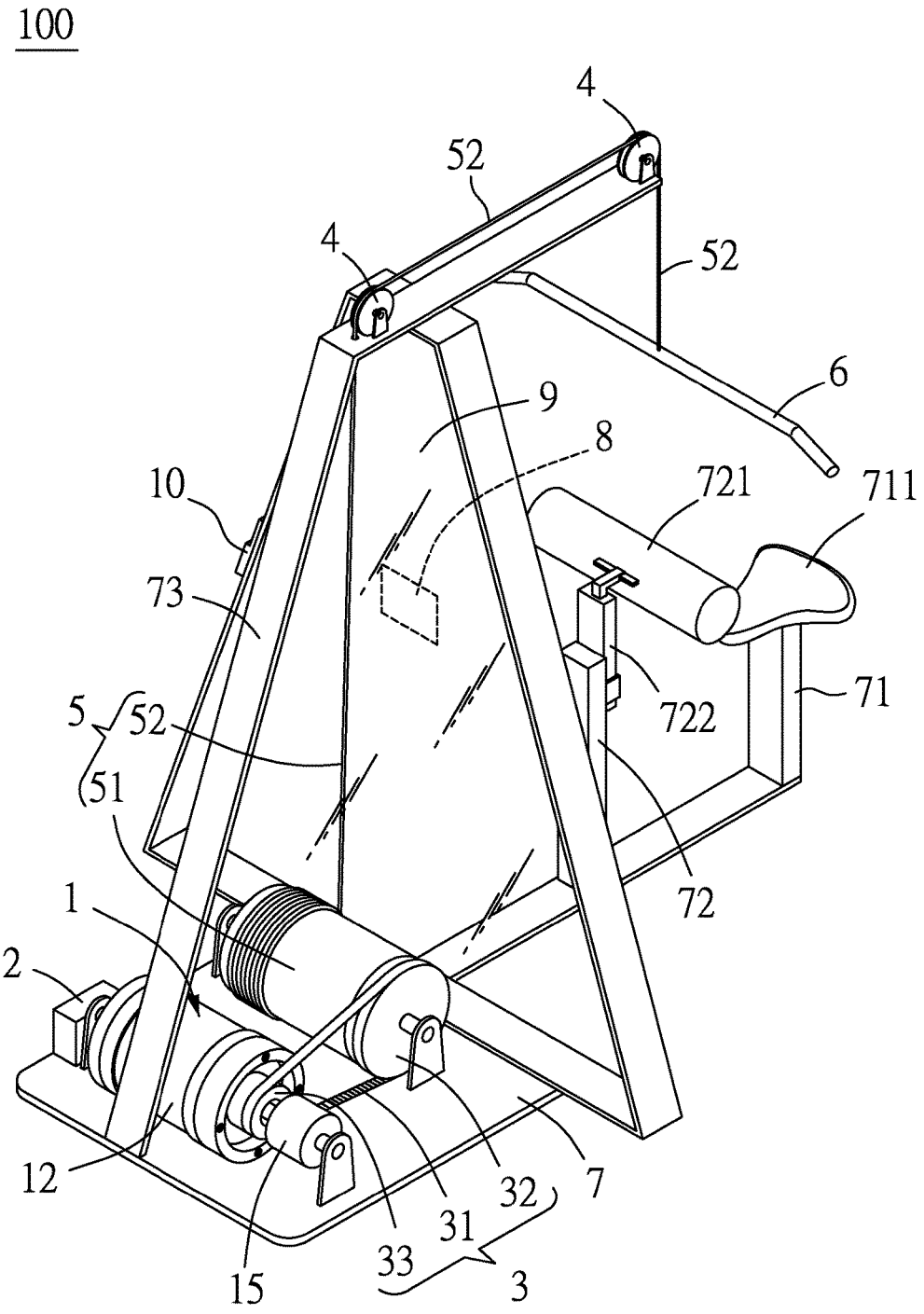
FIG. 1 is a perspective view of a lat pulldown fitness device according to the embodiment of the present invention.
Figure 2:
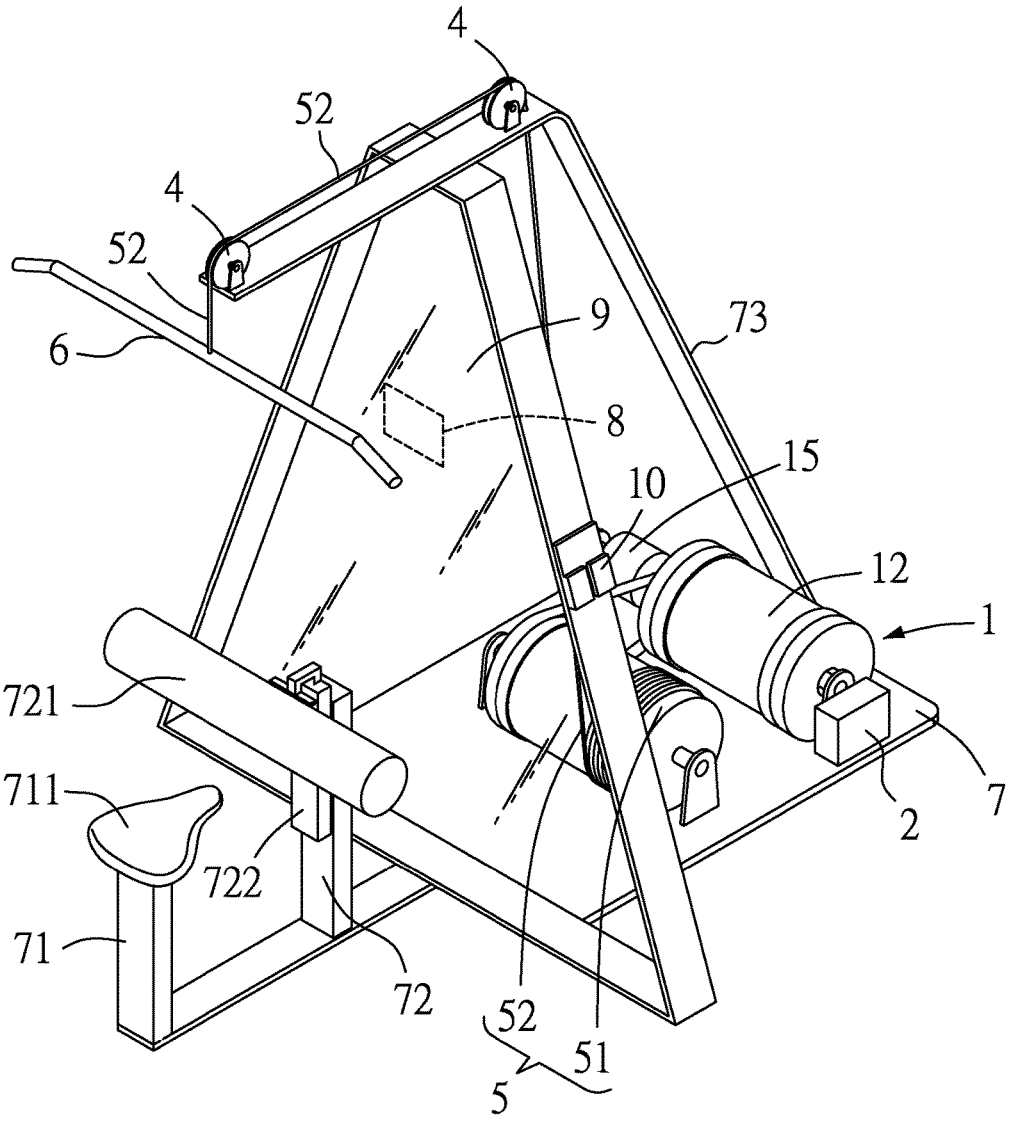
FIG. 2 is another perspective view of the lat pulldown fitness device according to the embodiment of the present invention.
Figure 3:
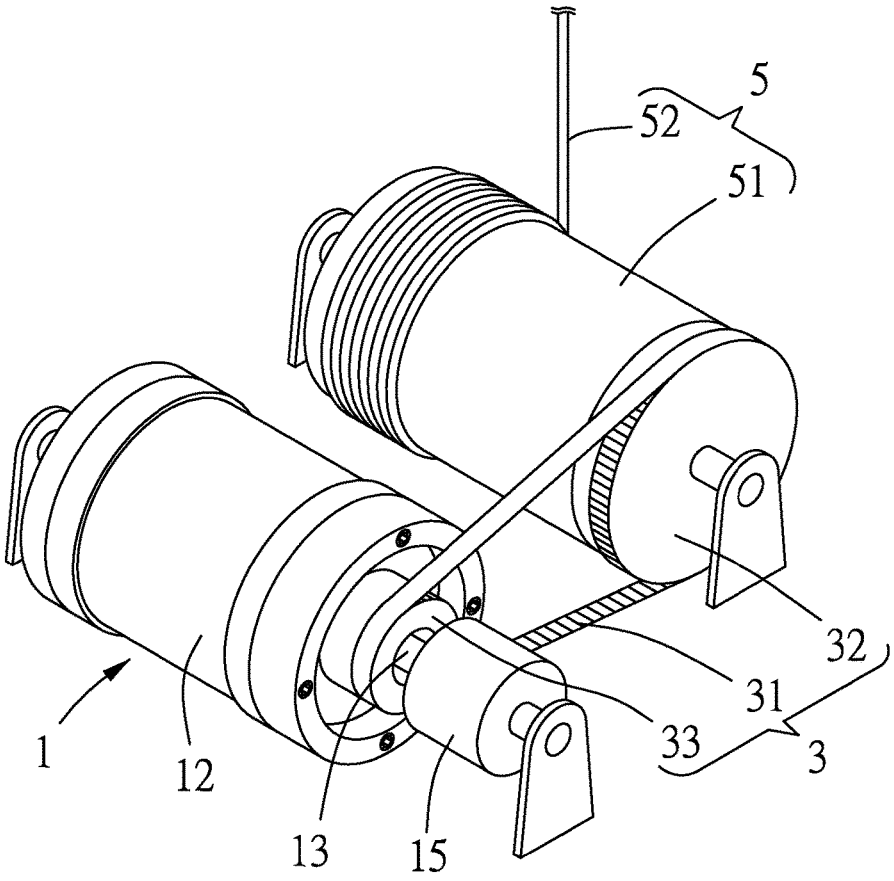
FIG. 3 is a partial enlarged view of the lat pulldown fitness device according to the embodiment of the present invention.

Referring to FIG. 1 through FIG. 3, in an embodiment of the present invention, a lat pulldown fitness device 100 comprises a magnetorheological fluid (MRF) resistance provider 1, a controller 2, a gear train 3, a plurality of pulleys 4, a cable assembly 5, a pulldown bar 6, and a base 7.

In this embodiment, disposed on the base 7 are a seat portion 71, a footrest portion 72, and a support frame 73. The footrest portion 72 is disposed between the seat portion 71 and the support frame 73. As shown in the diagram, disposed on the seat portion 71 is a pad 711, and disposed on the footrest portion 72 are a footrest bar 721 and an adjusting mechanism 722 for adjusting the height of the footrest bar 721. A user faces the footrest portion 72 while sitting on the pad 711. The adjusting mechanism 722 adjusts the height of the footrest bar 721 to suit the user's stature such that the user's legs can abut against the footrest bar 721 from below.

Figure 4:
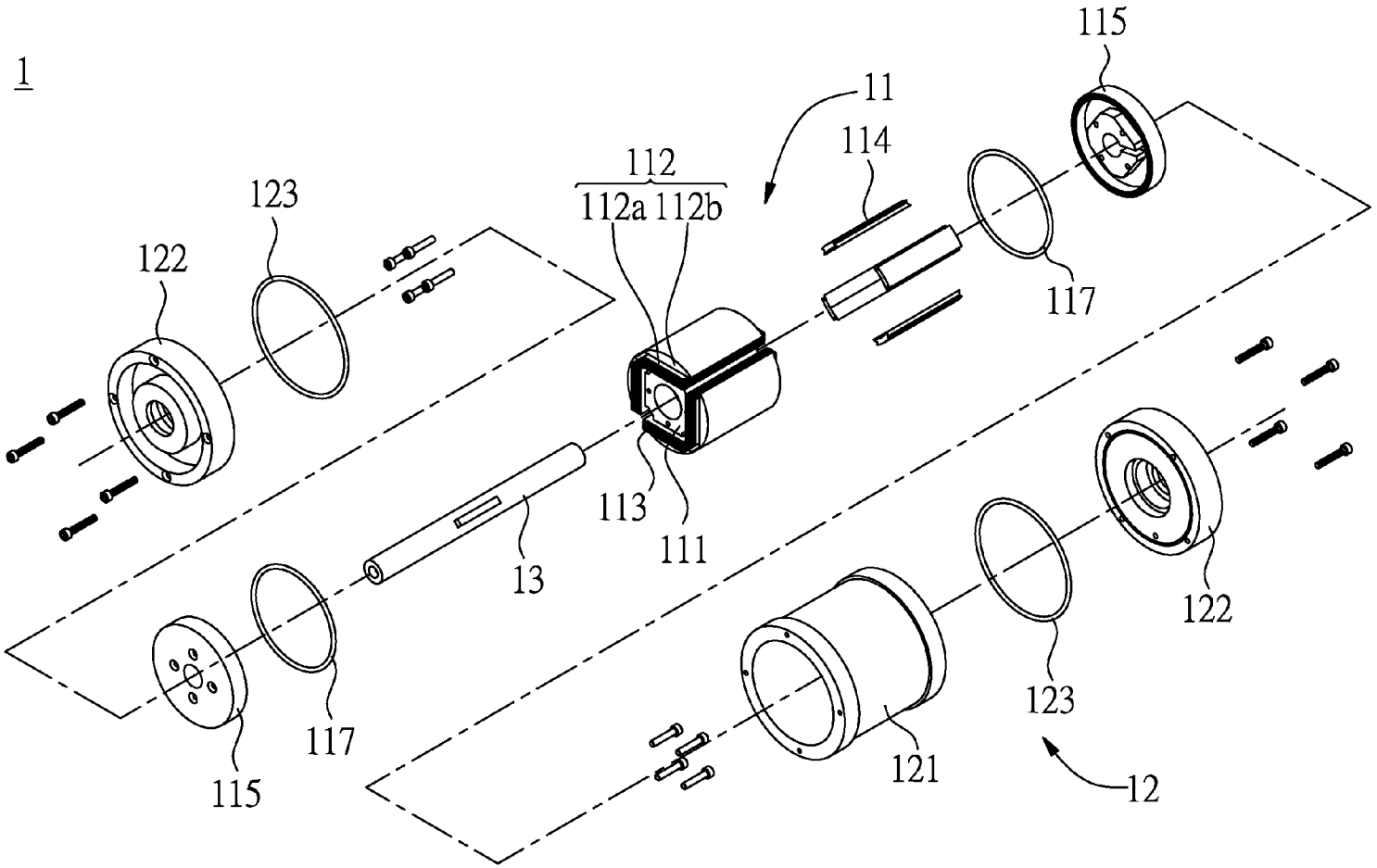
FIG. 4 is an exploded view of a magnetorheological fluid (MRF) resistance provider of the lat pulldown fitness device according to the embodiment of the present invention.
Figure 5:
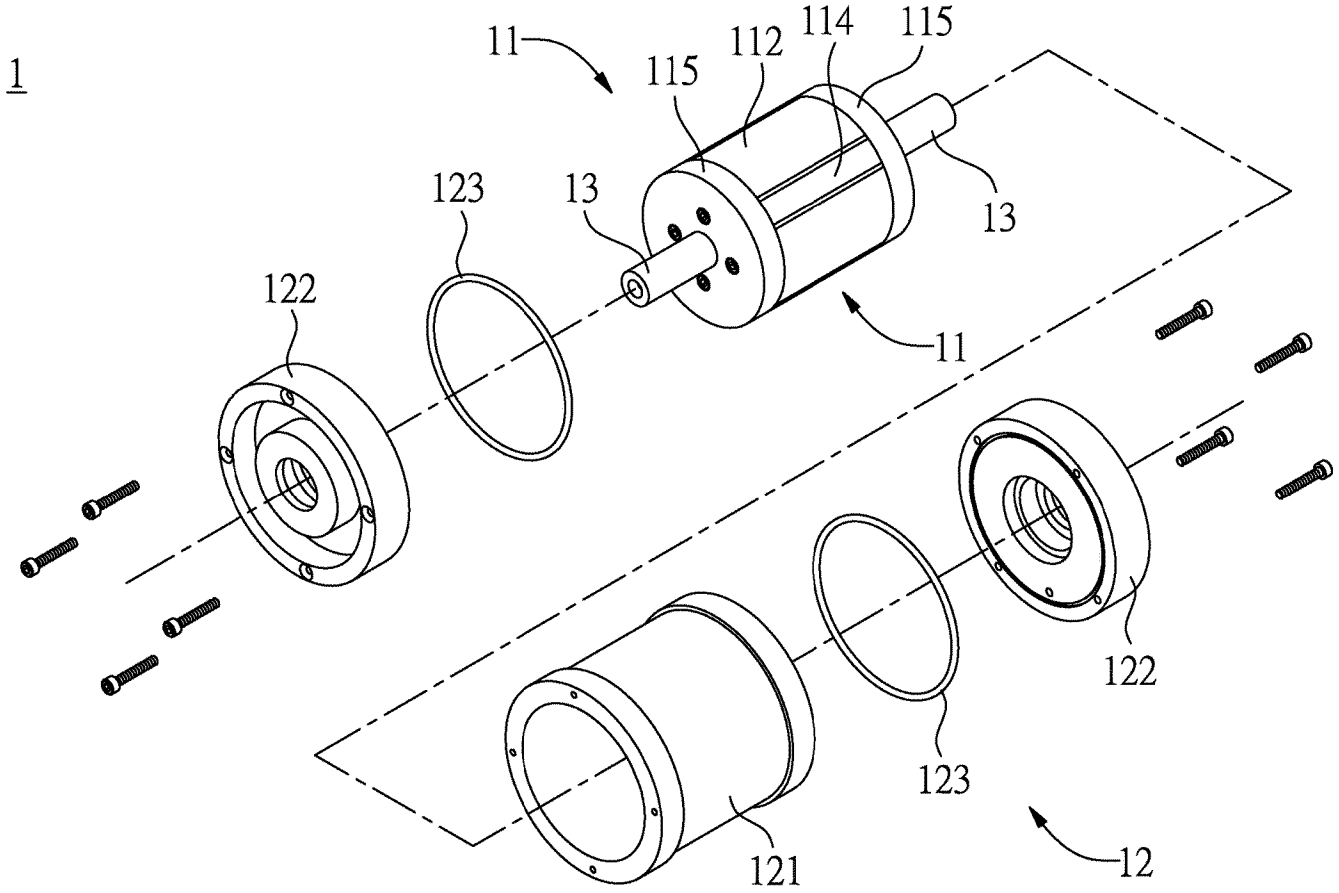
FIG. 5 is a partial exploded view of the MRF resistance provider of the lat pulldown fitness device according to the embodiment of the present invention.

In this embodiment, the MRF resistance provider 1 is disposed on the base 7 and comes in the form of a magnetorheological fluid (MRF) damper. Referring to FIG. 4 and FIG. 5, the MRF damper 1 comprises a magnetic field generating portion 11, a magnetically permeable external roller 12, and a shaft 13. The shaft 13 is coupled to the magnetic field generating portion 11 and received in the magnetically permeable external roller 12. The two ends of the shaft 13 stick out of the magnetically permeable external roller 12 and get fixed to the base 7 by a mounting base. One of the two ends of the shaft 13 connects to a spindle of a motor 15 in a manner that the MRF resistance provider 1 and the motor 15 are coaxial. The magnetically permeable external roller 12 rotates relative to the shaft 13 and the magnetic field generating portion 11. A magnetorheological fluid (MRF) 14 (shown in FIG. 6) is filled between the magnetically permeable external roller 12 and the magnetic field generating portion 11. With the magnetic field generating portion 11 generating a magnetic field, the MRF 14 generates an anti-shear stress between the magnetically permeable external roller 12 and the magnetic field generating portion 11 rotating relative thereto under the magnetic field.

In this embodiment, the gear train 3 is disposed on the base 7. Referring to FIG. 3, the gear train 3 comprises a chain 31, a large gear 32, and a small gear 33. The small gear 33 is coupled to the magnetically permeable external roller 12. The chain 31 connects the large gear 32 and the small gear 33. The gear train 3 serves as a deceleration mechanism whereby a torque produced by the MRF resistance provider 1 decreases because the gear ratio of the gear train 3 is less than 1.

In this embodiment, the pulleys 4 are disposed on the support frame 73. As shown in the diagram, this embodiment is exemplified by two pulleys 4, and the pulleys 4 are disposed above the seat portion 71 and above the cable assembly 5 on the support frame 73, respectively.

In this embodiment, referring to FIG. 3, the cable assembly 5 is disposed on the base 7. The cable assembly 5 comprises a reel 51 and a cable 52. The reel 51 and the large gear 32 are coaxially coupled together. A portion of the cable 52 winds around the reel 51, and another portion of the cable 52 straddles the pulleys 4.

In this embodiment, the pulldown bar 6 is disposed at an end of the cable 52 and hangs above the seat portion 71.

In this embodiment, the controller 2 is electrically connected to the MRF resistance provider 1 and the motor 15. The controller 2 controls the strength of the magnetic field generated from the magnetic field generating portion 11, controls the driving of the motor 15, and controls the MRF resistance provider 1 and the motor 15 to provide the downward-dragging weight to the cable 52. In this embodiment, the controller 2 is disposed on the base 7 or at any appropriate position.

The lat pulldown fitness device 100 according to the embodiment of the present invention is advantageously characterized in that: a current supplied to the MRF resistance provider 1 is adjusted by the controller 2 according to the strength level intended for the user, so as to control the strength of the magnetic field generated from the magnetic field generating portion 11 of the MRF resistance provider 1, thereby changing the magnitude of a resistance exerted by the MRF 14 on the magnetically permeable external roller 12. To operate the lat pulldown fitness device 100 according to the embodiment of the present invention, the user faces the footrest portion 72 while sitting on the pad 711, with his or her legs abutting against the footrest bar 721 from below, and his or her hands pulling the pulldown bar 6 downward until the pulldown bar 6 drags the cable 52 to drive the gear train 3. The small gear 33 drives the magnetically permeable external roller 12 of the MRF resistance provider 1 to rotate. The MRF 14 of the MRF resistance provider 1 operates in a magnetic field and produces an anti-shear stress between the magnetically permeable external roller 12 and the magnetic field generating portion 11 rotating relative to each other, thereby exerting a resistance on the magnetically permeable external roller 12. Hence, the torque exerted by the small gear 33 on the magnetically permeable external roller 12 is opposite to a resistance-producing torque generated from the MRF 14. The user must exert a torque larger than a resistance torque generated between the magnetically permeable external roller 12 and the magnetic field generating portion 11 by the MRF 14 in the MRF resistance provider 1 in order to pull the pulldown bar 6 downward for the sake of fitness training.

When the user stops pulling the pulldown bar 6 downward, the magnetically permeable external roller 12 of the MRF resistance provider 1 does not rotate relative to the magnetic field generating portion 11, and thus no anti-shear stress is produced between the magnetically permeable external roller 12 and the magnetic field generating portion 11, thereby preventing the MRF resistance provider 1 from exerting a downward-dragging resistance on the cable 52. At this point in time, the load weight is supplied by the motor 15, and the controller 2 drives the motor 15 to generate the torque for exerting the downward-dragging resistance on the cable 52. Hence, during a workout carried out with the lat pulldown fitness device 100 of the present invention, the user perceives a continuous and smooth downward-dragging resistance similar to that of the conventional lat pulldown fitness device.

Furthermore, as soon as the user slackens his or her grip on the pulldown bar 6, the motor 15 winds the cable 52 on the reel 51.

Therefore, the lat pulldown fitness device 100 according to the embodiment of the present invention is characterized advantageously in that: the MRF resistance provider 1 and the motor 15 operate in conjunction with each other to provide a downward-pulling weight; and a current supplied to the MRF resistance provider 1 is placed under the control of the controller 2 to control the MRF 14 by adjusting the strength of the magnetic field of the magnetic field generating portion 11, thereby adjusting the output resistance of the magnetically permeable external roller 12. Hence, the lat pulldown fitness device 100 according to the embodiment of the present invention changes a resistance precisely, conveniently, and quickly during a workout. Unlike the prior art which requires bumper plates, the lat pulldown fitness device 100 according to the embodiment of the present invention is not restricted to a unit bumper plate as far as weight adjustment is concerned and thus offers more choices and control resolutions in strength adjustment. Furthermore, the MRF resistance provider 1 of the lat pulldown fitness device 100 according to the embodiment of the present invention is compact and lightweight as compared to the prior art which discloses stacking up bumper plates, not to mention that the lat pulldown fitness device 100 of the present invention is thus compact and lightweight.

In this embodiment, the lat pulldown fitness device 100 further comprises a display screen 8. The display screen 8 is electrically connected to the controller 2. The magnitude of a resistance generated from the MRF resistance provider 1 and corresponding in strength to the current currently input by the controller 2 is displayed on the display screen 8. The display screen 8 is a touchscreen for displaying a user interface whereby the user operates and controls the controller 2 directly. Also, the display screen 8 displays a simulated situational view of an outdoor environment, a mountain, the seaside, and so on, such that the user finds a workout comfortable and pleasant. Furthermore, the display screen 8 is for use in playing teaching videos. Furthermore, the display screen 8 displays data pertaining to the accumulative number of grips and pulls, calories burned, and elapsed time. The controller 2 gets connected to a cloud database through a network so as to access, upload, and store past workout data and user profiles.

Referring to FIG. 1 and FIG. 2, in this embodiment, the lat pulldown fitness device 100 further comprises a reflection mirror 9 which is disposed upright on the base 7 and positioned between the footrest portion 72 and the gear train 3. As shown in the diagram, the reflection mirror 9 is mounted between the base 7 and the support frame 73, such that the user can see the reflection mirror 9 and check his or her own body posture during the workout. Furthermore, the display screen 8 is mounted on the reflection mirror 9 and lies at the same height as the eyes of an average user during a workout.

Referring to FIG. 1 and FIG. 2, in this embodiment, the lat pulldown fitness device 100 further comprises a chip reader 10 disposed on the support frame 73 and electrically connected to the controller 2. The chip reader 10 reads a chip card, wherein the chip card stores user profiles and past workout data.

Referring to FIG. 4 and FIG. 5, in this embodiment of the MRF resistance provider 1, the magnetic field generating portion 11 comprises a magnetically permeable body 111, even-numbered magnetic poles 112, even-numbered magnetically permeable coils 113, even-numbered spacers 114, and two first covers 115. This embodiment is exemplified by four magnetic poles 112, four magnetically permeable coils 113, and four spacers 114. The magnetic poles 112 are spaced apart and disposed circumferentially on the magnetically permeable body 111. The magnetically permeable coils 113 are each disposed around a corresponding one of the magnetic poles 112. The spacers 114 each adjoin two magnetic poles 112 to hermetically seal the space between the two magnetic poles 112. The first covers 115 flank the magnetically permeable body 111, the magnetic poles 112, and the spacers 114 so as for the magnetically permeable coils 113 to be hermetically sealed within a space defined jointly by the first covers 115, the magnetic poles 112, and the spacers 114. The shaft 13 is coupled to the magnetically permeable body 111 and sticks out of the first covers 115 and the magnetically permeable external roller 12. Bearings are disposed between the first covers 115 of the magnetically permeable external roller 12 and the shaft 13, such that the magnetically permeable external roller 12 can rotate relative to the shaft 13.

Figure 6:
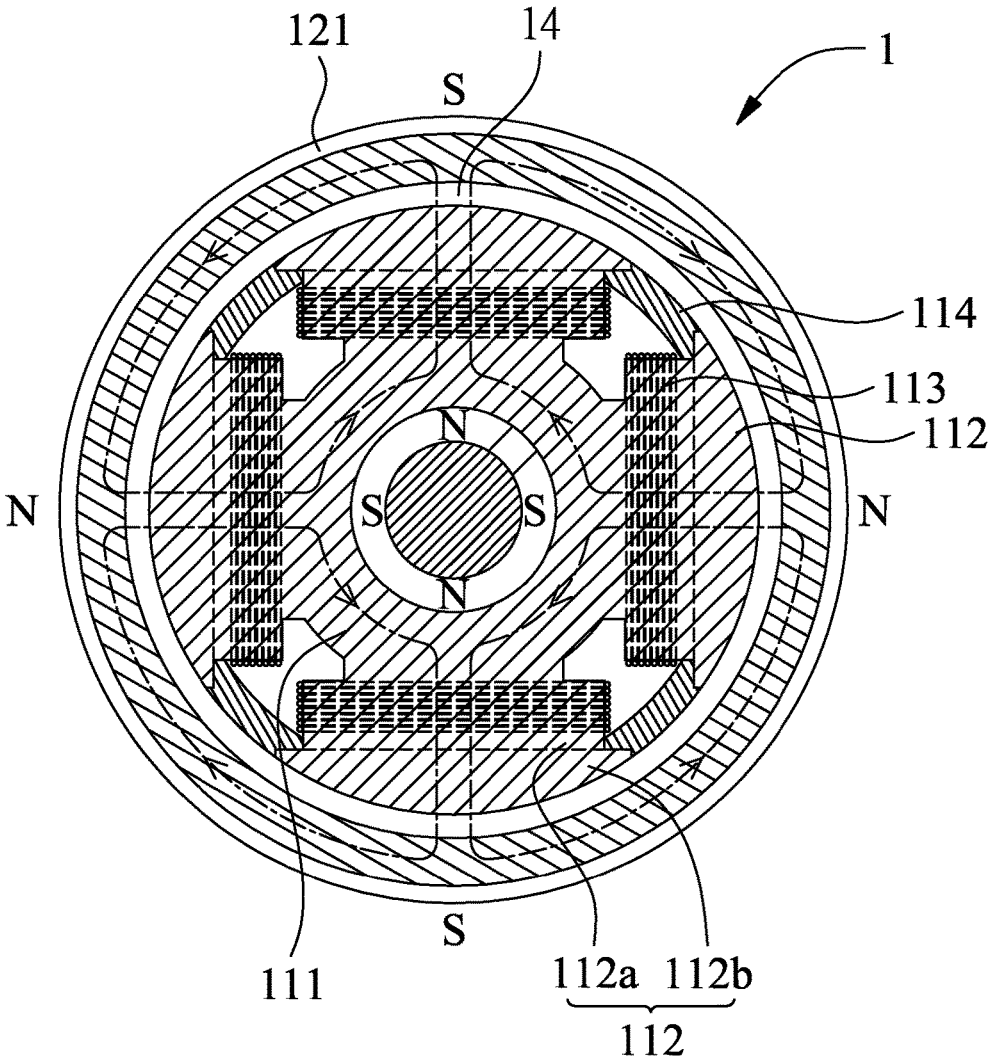
FIG. 6 is a cross-sectional view of the MRF resistance provider of the lat pulldown fitness device according to the embodiment of the present invention.

In this embodiment, currents in the magnetically permeable coils 113 of two adjacent magnetic poles 12 run in opposite directions. Referring to FIG. 6, the current-carrying magnetically permeable coils 113 cause the magnetic poles 112 to produce an N pole and an S pole because of electromagnetic induction, wherein the direction of the magnetic field generated from any one of the magnetic poles 112 because of induction is opposite to the direction of the magnetic field generated from two magnetic poles 112 adjacent to the magnetic poles 112 because of induction; hence, lines of magnetic force run from the N pole of any one of the magnetic poles 112 to the S pole of the adjacent magnetic pole 112 and is confined to the space defined between the magnetically permeable external roller 12 and the magnetic field generating portion 11. Therefore, the MRF between the magnetically permeable external roller 12 and the magnetic field generating portion 11 is subjected to the magnetic field.

Referring to FIG. 4 through FIG. 6, in this embodiment of the MRF resistance provider 1, the magnetic poles 112 each comprise a cylindrical magnetically permeable block 112*a* and a curved magnetically permeable head 112*b*. The curved magnetically permeable head 112*b* is wider than the cylindrical magnetically permeable block 112*a*. Referring to FIG. 6, the cross-section of each of the magnetic poles 112 is substantially T-shaped and has a curved top. The magnetically permeable coils 113 are each disposed around the cylindrical magnetically permeable block 112*a*. The spacers 114 are each curved, plate-like and disposed between two adjacent curved magnetically permeable heads 112*b*, such that the magnetic field generating portion 11 takes on a cylindrical shape upon completion of assembly. That is to say, after the spacers 114 and the curved magnetically permeable heads 112*b* have been put together, the cross-section of the magnetic field generating portion 11 is round.

Referring to FIG. 4 through FIG. 6, in this embodiment, the magnetic field generating portion 11 comprises two first washers 117. The first washers 117 are each disposed between the first covers 115, the curved magnetically permeable heads 112*b* of the magnetic poles 112, and the spacers 114 to prevent the MRF 14 from entering the magnetic field generating portion 11.

Referring to FIG. 4 and FIG. 5, in this embodiment of the MRF resistance provider 1, the magnetically permeable external roller 12 comprises an external cylinder 121, two second covers 122, and two second washers 123. The second covers 122 flank the external cylinder 121. The second washers 123 are each disposed between the second covers 122 and the external cylinder 121 to prevent the MRF 14 from leaking out of the MRF resistance provider 1.

In conclusion, the lat pulldown fitness device 100 according to the embodiment of the present invention is characterized advantageously in that: the MRF resistance provider 1 and the motor 15 operate in conjunction with each other to provide a downward-pulling weight; and a current supplied to the MRF resistance provider 1 is placed under the control of the controller 2 to control the MRF 14 by adjusting the strength of the magnetic field of the magnetic field generating portion 11, thereby adjusting the output resistance of the magnetically permeable external roller 12. Hence, the lat pulldown fitness device 100 according to the embodiment of the present invention changes a resistance precisely, conveniently, and quickly during a workout. Unlike the prior art which requires bumper plates, the lat pulldown fitness device 100 according to the embodiment of the present invention is not restricted to a unit bumper plate as far as weight adjustment is concerned and thus offers more choices and control resolutions in strength adjustment. Furthermore, the MRF resistance provider 1 of the lat pulldown fitness device 100 according to the embodiment of the present invention is compact and lightweight as compared to the prior art which discloses stacking up bumper plates, not to mention that the lat pulldown fitness device 100 of the present invention is thus compact and lightweight.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A lat pulldown fitness device, comprising:

a base, wherein a seat portion, a footrest portion, and a support frame are disposed on the base, with the footrest portion disposed between the seat portion and the support frame;

a magnetorheological fluid (MRF) resistance provider disposed on the base and provided in form of a magnetorheological fluid (MRF) damper including a magnetic field generating portion, a magnetically permeable external roller, and a shaft, with the shaft coupled to the magnetic field generating portion and received in the magnetically permeable external roller, wherein two ends of the shaft stick out of the magnetically permeable external roller, and one of the two ends connects to a spindle of a motor, wherein the magnetically permeable external roller rotates relative to the shaft and the magnetic field generating portion, wherein a magnetorheological fluid (MRF) is filled between the magnetically permeable external roller and the magnetic field generating portion, wherein the magnetic field generating portion generates a magnetic field under which the MRF generates an anti-shear stress between the magnetically permeable external roller and the magnetic field generating portion rotating relative to the magnetically permeable external roller;

a gear train disposed on the base and including a chain, a large gear, and a small gear, with the small gear coupled to the magnetically permeable external roller, wherein the chain connects the large gear and the small gear;

a plurality of pulleys disposed on the support frame;

a cable assembly disposed on the base and including a reel and a cable, with the reel coupled to the large gear, wherein a portion of the cable winds around the reel and another portion of the cable straddles the pulleys;

a pulldown bar disposed at an end of the cable and hanging above the seat portion; and a controller electrically connected to the MRF resistance provider and the motor, wherein the controller controls a strength of a magnetic field generated from the magnetic field generating portion and controllably drives the motor, so as to control a weight provided by the MRF resistance provider and the motor to pull the cable downward.

2. The lat pulldown fitness device of claim 1, further comprising a display screen electrically connected to the controller.

3. The lat pulldown fitness device of claim 2, further comprising a reflection mirror disposed upright on the base and positioned between the footrest portion and the gear train.

4. The lat pulldown fitness device of claim 3, wherein the display screen is a touchscreen mounted on the reflection mirror.

5. The lat pulldown fitness device of claim 4, further comprising a chip reader disposed on the support frame and electrically connected to the controller.

6. The lat pulldown fitness device of claim 1, wherein the magnetic field generating portion comprises a magnetically permeable body, even-numbered magnetic poles, even-numbered magnetically permeable coils, even-numbered spacers, and two first covers, wherein the magnetic poles are spaced apart and disposed circumferentially on the magnetically permeable body, with each said magnetically permeable coil disposed around a corresponding one of the magnetic poles, the spacers each adjoining two magnetic poles to hermetically seal a space between the two magnetic poles, the first covers flanking the magnetically permeable body, the magnetic poles, and the spacers so as for the magnetically permeable coils to be hermetically sealed within a space defined jointly by the first covers, the magnetic poles, and the spacers, with the shaft coupled to the magnetically permeable body and sticking out of the first covers and the magnetically permeable external roller.

7. The lat pulldown fitness device of claim 6, wherein currents in the magnetically permeable coils of two adjacent magnetic poles run in opposite directions.

8. The lat pulldown fitness device of claim 7, wherein the magnetic poles each comprise a cylindrical magnetically permeable block and a curved magnetically permeable head, with the magnetically permeable coil disposed around the cylindrical magnetically permeable block, with each said spacer being curved, plate-like and disposed between two adjacent curved magnetically permeable heads, such that the magnetic field generating portion takes on a cylindrical shape upon completion of assembly.

9. The lat pulldown fitness device of claim 8, wherein the magnetic field generating portion comprises two first washers each disposed between the first covers, the curved magnetically permeable heads of the magnetic poles, and the spacers, respectively.

10. The lat pulldown fitness device of claim 1, wherein the magnetically permeable external roller comprises an external cylinder, two second covers, and two second washers, with the second covers flanking the external cylinder, and with the second washers each disposed between the second covers and the external cylinder.

* * * * *